United States Patent [19]

Matthews

[11] 4,295,273

[45] Oct. 20, 1981

[54] COMBINATION CARPET RAZOR KNIFE AND GUIDE

[76] Inventor: James Matthews, 11373 121st Ter. N., Largo, Fla. 33540

[21] Appl. No.: 113,070

[22] Filed: Jan. 17, 1980

[51] Int. Cl.[3] ..... B26B 29/00

[52] U.S. Cl. ..... 30/293; 30/294; 30/310

[58] Field of Search ..... 30/293, 294, 310, 300

[56] References Cited

U.S. PATENT DOCUMENTS

| | | | |
|---|---|---|---|
| 41,797 | 3/1864 | Van Deventer | 30/293 |
| 1,140,233 | 5/1915 | Anderson | 30/294 |
| 1,182,629 | 5/1916 | Birnbaum | 30/310 |
| 1,719,663 | 7/1929 | Koontz | 30/300 |
| 2,098,641 | 11/1937 | Cook | 30/293 |
| 2,282,729 | 5/1942 | Knauf | 30/293 |
| 2,716,282 | 8/1955 | Kromsten | 30/310 |
| 3,191,295 | 6/1965 | Falk | 30/293 |
| 3,889,368 | 6/1975 | Himeno | 30/294 |
| 3,898,735 | 8/1975 | Himeno | 30/294 |

FOREIGN PATENT DOCUMENTS

| | | | |
|---|---|---|---|
| 534581 | 9/1931 | Fed. Rep. of Germany | 30/293 |

*Primary Examiner*—Stephen G. Kunin
*Assistant Examiner*—J. T. Zatarga
*Attorney, Agent, or Firm*—Ronald E. Smith

[57] ABSTRACT

A combination carpet razor knife and guide. In known carpet razor knives, a screw retains a razor in sandwiched relation to the opposed halves of the carpet razor knife body. In the invention, this screw is utilized to fixedly secure an arm to the knife, at right angles thereto, the arm being adapted to secure a depending guide in a plurality of functional positions of horizontal adjustment relative to the razor. The novel guide produces a new method for making a substantially perfect seam between abutting carpets.

1 Claim, 4 Drawing Figures

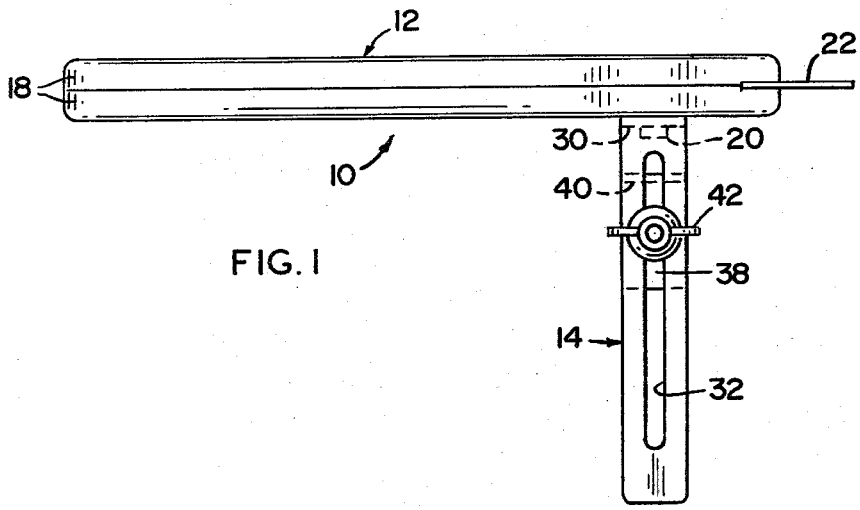
FIG. 1
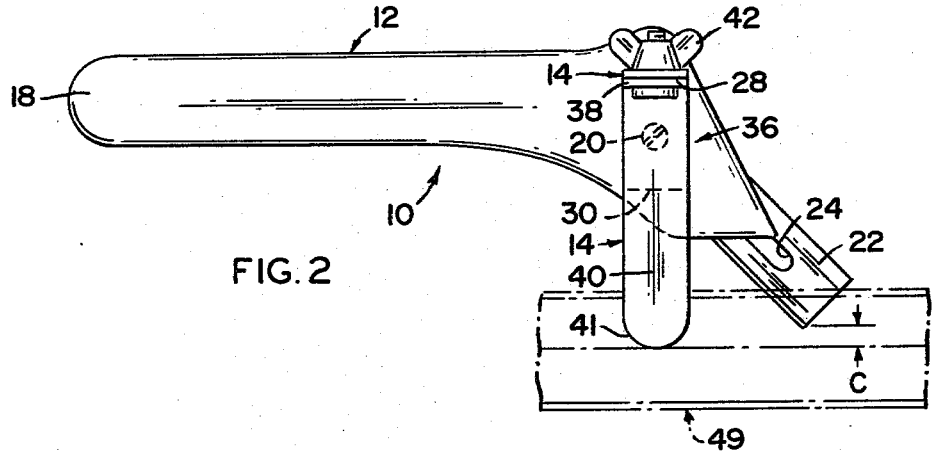
FIG. 2
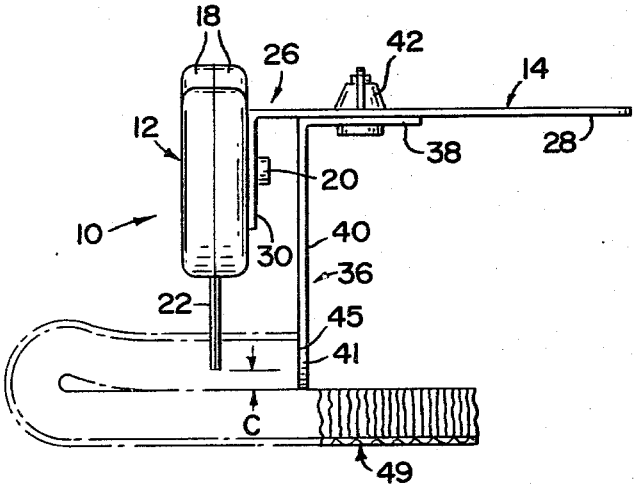
FIG. 3
FIG. 4
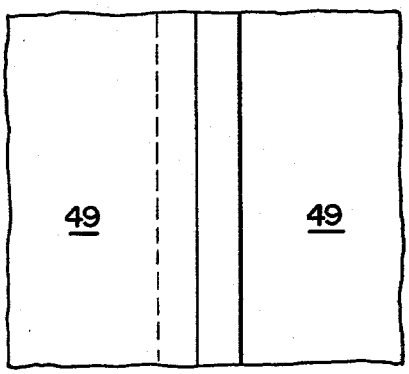

COMBINATION CARPET RAZOR KNIFE AND GUIDE

BACKGROUND OF THE INVENTION

1. Field of the Invention

This invention relates generally to improvements in carpet razor knives, and more particularly to an adjustable guide means and consequently to an improved method for using such knives in trimming the salvage edge of carpeting.

2. Description of the Prior Art

Carpet razor knives are used by carpet layers for general installation work and consequently are well known. A typical carpet has a nap portion and a backing portion. The nap portion is generally embedded in and permanently secured to the backing portion.

When carpeting is being installed, a problem routinely encountered involves seaming the border areas where two rooms or living areas meet. The two disparate carpets should meet in an optimal manner so that the juxtaposition line formed by the two carpets is not readily apparent to the casual observer.

The conventional method of producing the desired seam, known as the double cut method, is as follows. The abutting edge of one of the carpets is made to overly the abutting edge of the underlying carpet. The amount of overlap might be for example an inch or two. A carpet razor knife is then used to cut both carpet protions at the same time, by guiding the knife on a straight line through the medial region of the overlapping area. Since this cut is made when the nap portion of each carpet is facing upwardly i.e., toward the razor, shear tips will be produced. In other words, on both of the carpets, the nap immediately adjacent the cut will be shorter than the nap spaced apart from the cut.

It is therefore necessary to trim the salvage edge off of both of the carpets to thereby remove that portion of the nap cut by the razor and having a short length in consequence thereof.

There are two known methods for trimming the salvage edge. In both methods, the salvage edge (that portion of the carpet carrying short nap), is trimmed by folding the carpet over upon itself, to expose the backing. Since the double cut has produced mating edges, spoiled only by the short nap adjacent the cut line, the salvage edge must be trimmed along a straight line to preserve the substantially perfect seam produced by the double cut. The first of the two known methods, therefore, incorporates the use of a straight edge tool, preferably of four to six feet in length. The straight edge is carefully placed in parallel alignment with the salvage edge to be removed, and a carpet razor knife is used to make the cut, using the straight edge of a guide. The second known method contemplates snapping a conventional chalk line to produce a straight chalk line in spaced apart parallel alignment with the salvage edge to be trimmed, followed by, of course, cutting along the line with the carpet razor knife.

It should be noted that a considerable amount of skill is needed to properly align either the straight edge of the chalk line and to make the cut along the line so defined. Also, due to the level of skill required, it will also be appreciated that the time required to trim a salvage edge by either of the two known methods is substantial. Morever, since neither the straight edge or the chaulk line can be placed close to the salvage edge to be trimmed, excess amounts of carpeting must be trimmed off.

Both of the known methods suffer from yet another problem. The act of folding the carpet over upon itself introduces a bowed effect into the carpeting. Thus, any attempt to cut along a straight line will fail, and a substantially perfect seam cannot be made. The seemingly straight line, in other words will actually follow an arcuate or curved path. Thus, the substantially perfect seam that had been produced by the double cut is lost in the process of trimming the short nap carrying salvage edge.

SUMMARY OF THE INVENTION

A salvage edge trimmer is therefore disclosed that comprises a conventional carpet razor knife and a novel guide means. The novel guide means holds the razor of the conventional knife in fixed spaced relation to the edge of the carpet that has been folded back upon itself for the purpose of trimming its salvage edge. The fixed spacial relationship between the razor and carpet edge is maintained through the trimming operation, thereby maintaining the substantially perfect seam that was produced by the double cut. Thus the bowed effect is overcome. Also, the spatial distance between the razor and the guide may be as little as one-fourth inch thereby reducing the amount of carpeting wasted by the salvage edge trimming operation.

It is therefore seen to be an important object of the invention to provide a tool and method for preserving the substantially perfect seam created by the double cut even after the salvage edge has been trimmed.

Another object is to provide a method of trimming salvage edges that reduces the amount of carpet wasted by the methods and tools of the prior art to an irreducible minimum.

Still another object is to provide an adjustable guide means so that the amount of salvage edge to be trimmed from a carpet can be predetermined by the user of the invention.

Still another object of the invention is to reduce the skill level required in producing substantially perfect seams in abutting carpeting, so that abutting carpets installed by inexperienced or substantially unskilled personel will have a substantially perfect seam.

Yet another object is to reduce the amount of time required to install abutting carpets having a substantially perfect seam therebetween.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which:

FIG. 1 is a plan view of the preferred embodiment of the present invention.

FIG. 2 is a side elevational view of the preferred embodiment.

FIG. 3 is a front elevational view of the preferred embodiment.

FIG. 4 is a diagrammatical plan view of two abutting carpets, showing one carpet edge disposed in overlying relation to the underlying adjacent carpet edge.

Similar reference characters refer to similar parts throughout the several views of the drawings.

DETAILED DESCRIPTION OF THE PREFERRED EMBODIMENT

An illustrative embodiment of the invention is shown in FIG. 1, and is generally designated 10.

The inventive tool comprises in combination, the known carpet razor knife, generally designated 12, and the now disclosed guide assembly, generally designated 14.

The known knife 12 is longitudinally bifurcated, having two complementally formed opposed body portions 18 held together by a screw means 20. A razor 22 having an elongate slot 24 formed therein is held between the opposed halves 18 of the knife 12 in sandwiched relation. The screw 20 passes through razor slot 24 and thus enables the razor 22 to extend from the knife 12 or to retract thereinto to thereby expose differing lengths of the razor 22.

The inventive guide assembly 14 utilizes the retaining screw 20. The guide assembly 14 has a support arm generally designated 26, and a guide member, generally designated 36. The support arm 26 has an elongated horizontally disposed portion 28 and a vertically disposed portion 30 formed integrally therewith. An aperture is formed substantially centrally of the vertical portion 30 for receiving screw means 20 therein to thereby fixedly secure the support arm 26 to the known knife 12.

The horizontal portion 28 of the support arm 26 has a longitudinally disposed elongate slot 32 formed therein. A wing nut assembly 42 extends through the slot 32 for slidably retaining the horizontal portion 38 of the guide means 36. The horizontal portion 38 of the guide means 36 is bent orthogonally to form a vertically disposed portion 40 that is aligned in spaced parallel relation with the razor 22 and extends beyond the farthest reach of the razor 22 by an amount designated C.

When the invention 10 is in use, the peripheral edge of the carpet 49 bears against that portion of the vertically disposed arm 40 having outermost portion C. To facilitate the use of the invention 10, the outermost portion C of the vertical arm 40 is rounded as at 41 to avoid snagging the arm 40 and the carpet 49.

Alternatively a wheel means (not shown) could be provided on the distal end of the arm 40, in lieu of rounded portion 41.

To make a substantially perfect seam between abutting carpets, one carpet 49 is made to overlie the other carpet 49 so that the carpets 49 overlap somewhat, as shown in FIG. 4. A double cut is made, longitudinally bisecting the overlap area so that a strip of carpeting is removed from both the overlying and the underlying carpet. It should be appreciated that the carpets will form a substantially perfect seam at this point due to the simultaneous cutting of both carpets. The only defect, as aforesaid, lies in the presence of short nap adjacent the cut line. It will be noted that the inventor's method has already eliminated the prior art step of bisecting the overlapping area by cutting a strictly straight line. Since the prior art methods relied on trimming the salvage edge, i.e., removing the short nap-carrying protions, by trimming the salvage edge along a straight line generated by either a straight edge tool or a chalk line, the prior art obviously required that the initial longitudinal cut also be made along a straight line. Otherwise, a straight cut generated by either a straight edge tool or a chalk line will be out of alignment with the initial double cut resulting in a less-than-perfect seam. Accordingly, an important object of the invention, i.e., to lower the level of skill required to make a substantially perfect seam between abutting carpets, has been achieved, since the initial double cut need not now be made along a perfectly straight line, since the inventive tool, the salvage edge trimmer 10 will always make its cut by following the contour of the initial cut. Thus, it matters not whether the initial double cut is perfectly straight.

The contour of the initial cut is followed by folding a carpet to be trimmed back over upon itself to expose its backing. As in the prior art methods, the purpose of making the salvage edge trim from the backing side of the carpet is to avoid cutting the nap. The inventive salvage edge trimmer is then held so that the razor 22 is positioned as closely as ¼ inch from the peripheral edge 45 of the carpet 49. The wing nut assembly 42 is loosened so that guide member 36 slides within the elongate slot 32 of the horizontal portion 28 of the support arm 26 until depending portion C of the guide member 36 engages the peripheral edge 45 of the carpet 49.

The razor is then brought into cutting relationship with the edge 45 to be trimmed, while a substantially constant pressure is brought to bear against the depending portion C of the guide means 36 so that the depending portion C bears against the peripheral edge 45 of the carpet 49 thereby following the contour of the initial double cut and thereby defining the path of the razor 22. The rounded portion 41 slides along the nap of the carpet 49 underlying the peripheral edge of 45.

Clearly, then, the resulting salvage edge can be as narrow as ¼ inch. This contrasts sharply with the salvage edges resulting from prior art devices and earlier methods.

Repeating this procedure with the other carpet 49 produces a substantially perfect seam, since the peripheral edges 45 of the carpet 49 form a substantially perfect mating seam when intitially cut, due to the above-described doublecut procedure. Since the guide means 36 causes the razor means 22 to precisely follow the peripheral edges 45, the substantially perfect seam is maintained when the salvage edge of each carpet 49 is trimmed with the inventive tool.

A channel (not shown) may be formed in the body of the knife 12 for receiving the vertical portion 30 of the support arm 26 to further bar relative rotation between the support arm 26 and the knife 12.

It will thus be seen that the objects set forth above, and those made apparent from the preceding description, are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

Now that the invention has been described,

What is claimed is:

1. A device for cutting carpets, comprising, in combination, a blade having a cutting edge and an elongated longitudinally extending central slot formed in said blade, said slot formed in parallelism with said cutting edge, an elongate handle member, a blade-retaining member, said blade-retaining member integrally formed with said elongate handle member, said elongate handle member and said blade-retaining member disposed in co-planar relation to one another, said blade-retaining member disposed in angular relation to said elongate handle member, an internally threaded bore formed in said blade-retaining member, said bore orthogonally disposed relative to the plane of said elongate handle member and said blade-retaining member, said blade-retaining member adapted to slidingly receive said blade member so that said blade member is disposed in sandwiched relation to said blade-retaining member and so that the slot formed in said blade member is aligned with said bore throughout a plurality of functional positions of adjustment of said blade member, a first L-shaped member having a truncate leg portion and an elongate leg portion, said truncate leg portion having an aperture means formed therein, said truncate leg portion disposed so that said aperture means formed therein is in aligned relation with said internally threaded bore formed in said blade-retaining member, a first bolt member aligned with and extending through said truncate leg portion aperture means, said internally threaded bore and said slot formed in said blade member so that said first bolt member, when in secure screw-threaded engagement with said internally threaded bore, secures the truncate leg portion of said first L-shaped member to said blade-retaining member, in abutting relation thereto, and maintain the sandwiched relation between said blade member and said blade-retaining member, said elongate leg portion disposed at right angles to the plane of said blade-retaining member when said truncate leg portion is secured to said blade-retaining member, said elongate leg portion being substantially flat and being generally disposed in a horizontal plane, said elongate leg portion having a longitudinally extending central slot, a second L-shaped member having a truncate leg portion and an elongate leg portion substantially orthogonally disposed relative to said truncate portion, an aperture formed substantially centrally of said truncate leg portion, said truncate leg portion being flat and disposed in abutting relation to the underside of said elongate leg portion of said first L-shaped member so that the aperture formed in said truncate leg portion of said second L-shaped member is in registration with the longitudinally extending slot formed in the elongate leg portion of said first L-shaped member throughout a plurality of functional positions of adjustment of said second L-shaped member relative to said first L-shaped member, a bolt member aligned with and extending through said aperture means in said truncate leg portion of said second L-shaped member and said slot formed in the elongate leg portion of said first L-shaped member, said elongate leg portion of said second L-shaped member disposed in spaced apart, substantially parallel relation to the common plane of said handle member and said blade-retaining member when the truncate leg portion of said second L-shaped member is disposed in abutting relation to the elongate leg portion of said first L-shaped member, said elongate leg portion of said second L-shaped member having a distal end portion that extends beyond the distal end of said blade member so that at least a portion of said distal end of such elongate leg portion slidedly engages a carpet edge when said blade member is disposed in cutting relation to a carpet, said distal end portion of said elongate leg portion thereby serving as a cam follower means that effectively communicates the contour of a carpet edge to said blade member, a wing head engaged in screw threaded relation to said second bolt so that the apertured truncate leg portion of said second L-shaped member and the slotted elongate leg portion of said first L-shaped member are releasably secured to one another, said truncate leg portions of said second L-shaped member and hence said elongate leg portion of said second L-shaped member being positionable in a plurality of functional positions of adjustment attendant loosening and tightening of said wing head, so that the spaced apart relation of said elongate leg portion of said second L-shaped member and said blade member is variable, whereby a substantially perfect seam between two abutting carpets is at least in part provided by loosening said wing head, positioning said blade member and the elongate leg portion of said second L-shaped member in a preselected spaced apart relation such that said elongate leg portion of second L-shaped member is substantially parallel to said blade member, tightening said wing head to fix the spaced apart relation of said blade member and said elongate leg portion of said second L-shaped member, positioning the abutting edges of said abutting carpets so that one edge overlies the other, cutting both of said carpets with a conventional top cutter tool so that the cut made in the backing of the overlying carpet is in substantial vertical alignment with the cut made in the backing of the underlying carpet through the length of said cut, cutting a first salvage edge from the overlying carpet by placing the overturned edge of said carpet in sliding abutting relation to the elongate leg portion of said second L-shaped member and cutting the backing of said carpet with said blade while maintaining the sliding abutting relation of said carpet edge and said elongate leg portion of said second L-shaped member so that the cut so made in said backing is substantially parallel to the cut made in said backing by said top cutter tool, said distal end portion of such elongate leg portion of said second L-shaped member thereby serving as a cam follower means that effectively communicates the contour of a carpet edge to said blade member, and cutting a salvage edge from said underlying carpet in a like manner, whereby the respective cuts made in the backing of said abutting carpets by said blade follow the contour of the respective cuts made in the backings of said carpets by said conventional top cutter means, which cuts made in said overlying and underlying carpets by said conventional top cutter means define a mating profile, so that the backings of the carpets will mate when said carpets are placed in upturned, side-by-side relation to one another, such that a substantially perfect seam is formed between said abutting carpets.

* * * * *